US006250883B1

(12) United States Patent
Robinson et al.

(10) Patent No.: US 6,250,883 B1
(45) Date of Patent: Jun. 26, 2001

(54) INTEGRAL CERAMIC BLISK ASSEMBLY

(75) Inventors: Daniel Joe Robinson, Scottsdale; Walter Lee Meacham, Phoenix, both of AZ (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/290,593

(22) Filed: Apr. 13, 1999

(51) Int. Cl.[7] ..... F01D 5/06

(52) U.S. Cl. ..... 416/198 A; 416/201 R; 416/241 B; 416/204 A; 416/244 A

(58) Field of Search ..... 416/198 A, 200 A, 416/201 R, 234, 241 B, 204 A, 244 R, 244 A, 241 R; 415/199.4, 199.5; 403/29

(56) References Cited

U.S. PATENT DOCUMENTS

| | | | | |
|---|---|---|---|---|
| 2,683,018 | | 7/1954 | Schorner . | |
| 2,821,357 | | 1/1958 | Schorner . | |
| 2,874,932 | | 2/1959 | Sorensen . | |
| 3,888,602 | * | 6/1975 | Nichols et al. | 416/198 A |
| 3,943,703 | | 3/1976 | Kronogard . | |
| 4,011,737 | | 3/1977 | Kruger et al. . | |
| 4,051,585 | | 10/1977 | Walker et al. . | |
| 4,111,603 | | 9/1978 | Stahl . | |
| 4,169,694 | | 10/1979 | Sanday . | |
| 4,207,029 | | 6/1980 | Ivanko . | |
| 4,417,854 | | 11/1983 | Cain et al. . | |
| 4,878,812 | * | 11/1989 | Kito et al. | 416/241 B |
| 5,104,747 | * | 4/1992 | Makino et al. | 409/29 |
| 5,860,789 | * | 1/1999 | Sekihara et al. | 416/198 A |

FOREIGN PATENT DOCUMENTS

| | | |
|---|---|---|
| 2915292 | 10/1980 | (DE) . |
| 3532348 | 3/1986 | (DE) . |
| 2034440 | 6/1980 | (GB) . |

OTHER PUBLICATIONS

"Brevet D'Invention. Rotor en matieres ceramiques, en particular pour turbines a gaz," Ministere de la Production Industrielle, Republique Francaise, Apr. 1944.

* cited by examiner

*Primary Examiner*—F. Daniel Lopez
*Assistant Examiner*—Richard Woo

(57) ABSTRACT

An integral blisk assembly includes a ceramic blisk having a forward and aft axial facing surface. To allow for torque transfer from the blisk, a forward and aft attachment ring contact the forward and aft axial facing surfaces respectively. These rings are mounted to other rotating components in the engine and are made of metal. A metal shim or precious metal coating may be disposed between the contacting surfaces to further reduce any stresses at the point of contact. To provide radial piloting, metal pilot rings are disposed underneath the regions where the attachment rings and blisk make contact. The aft attachment ring also has an axially extending base portion that in the event of a blisk failure contacts a stop that extends inwardly from the forward attachment ring, thereby preventing the other components in the engine from shifting.

18 Claims, 5 Drawing Sheets

INTEGRAL CERAMIC BLISK ASSEMBLY

U.S. GOVERNMENT RIGHTS

The Government of the United States of America has rights in this invention pursuant to Contract No. DE-AC02-96EE50454 awarded by the U.S. Department of Transportation.

TECHNICAL FIELD

The present invention relates to gas turbine engines and in particular to ceramic turbine wheels for use in such engines.

BACKGROUND OF THE INVENTION

It has long been recognized that the efficiency and performance of gas turbine engines could be improved by increasing the temperature of the gas through the engine's turbine section. Historically, these temperatures have been limited by the materials used, usually high temperature steel or nickel alloys, to form the first stage turbine wheel. The first stage being downstream of the engine's combustor experiences some of the highest gas and metal temperatures in the engine. To permit higher gas temperatures it has been proposed to form the first stage turbine wheel from a ceramic material such as silicon nitride ($Si_3N_4$) or silicon carbide (SiC). In particular, it is has been proposed to use a ceramic blisk wheel, which is a wheel where the blades and disk are one piece. However, the attachment of a ceramic blisk to surrounding metal components in an engine is complicated by their different thermal expansion properties. Metals expand and contract as temperature changes while ceramics in comparison expand and contract very little. Thus, the attachment mechanism used to mount the ceramic blisk in an engine must meet a number of criteria. First, it must provide the proper radial positioning, also referred to as piloting, of the blisk to control any unbalance which may result in unacceptable engine vibration. Second, it must be able to transfer torque from the blisk to the engine shaft without generating unacceptable contact stresses on the blisk. Lastly, it must maintain the integrity of the engine components in the event that the blisk fails. Unlike metals, when ceramic fails it often powderizes. For a ceramic blisk in a stack of components which are secured by a tieshaft, loss of the blisk will leave an axial gap. Due to axial forces acting on the components, these components will move axially to fill this gap, which can result in a failure of the entire engine.

Accordingly, a need exists for a mounting assembly for holding a ceramic blisk in a gas turbine engine that provides the proper radial positioning, allows torque transfer without undue contact stress, and maintains the integrity of the rotating components in the event of a failure of the blisk.

SUMMARY OF THE INVENTION

An object of the present invention is to provide a ceramic blisk assembly that properly positions the blisk in the radial direction.

Another object of the present invention is to provide a ceramic blisk assembly that allows for torque transfer without generating unacceptable contact stresses on the blisk.

Yet another object of the present invention is to provide a ceramic blisk assembly that maintains the integrity of the rotating components in the event that the blisk fails.

The present invention accomplishes these objects by providing a ceramic blisk assembly that comprises a ceramic blisk having a forward and aft axial facing surface. To allow for torque transfer from the blisk, a forward and aft attachment ring contact the forward and aft axial facing surfaces respectively. These rings are mounted to other rotating components in the engine and are made of metal. A metal shim or precious metal coating may be disposed between the contacting surfaces to further reduce any stresses at the point of contact. To provide radial piloting, metal pilot rings are disposed underneath the regions where the attachment rings and blisk make contact. Lastly, the aft attachment ring has an axially extending base portion that is slightly spaced apart from a stop that extends inwardly from the forward attachment ring. This arrangement prevents the other components in the engine from shifting in the event that the blisk fails.

DESCRIPTION OF THE PREFERRED EMBODIMENT

Figure 1:
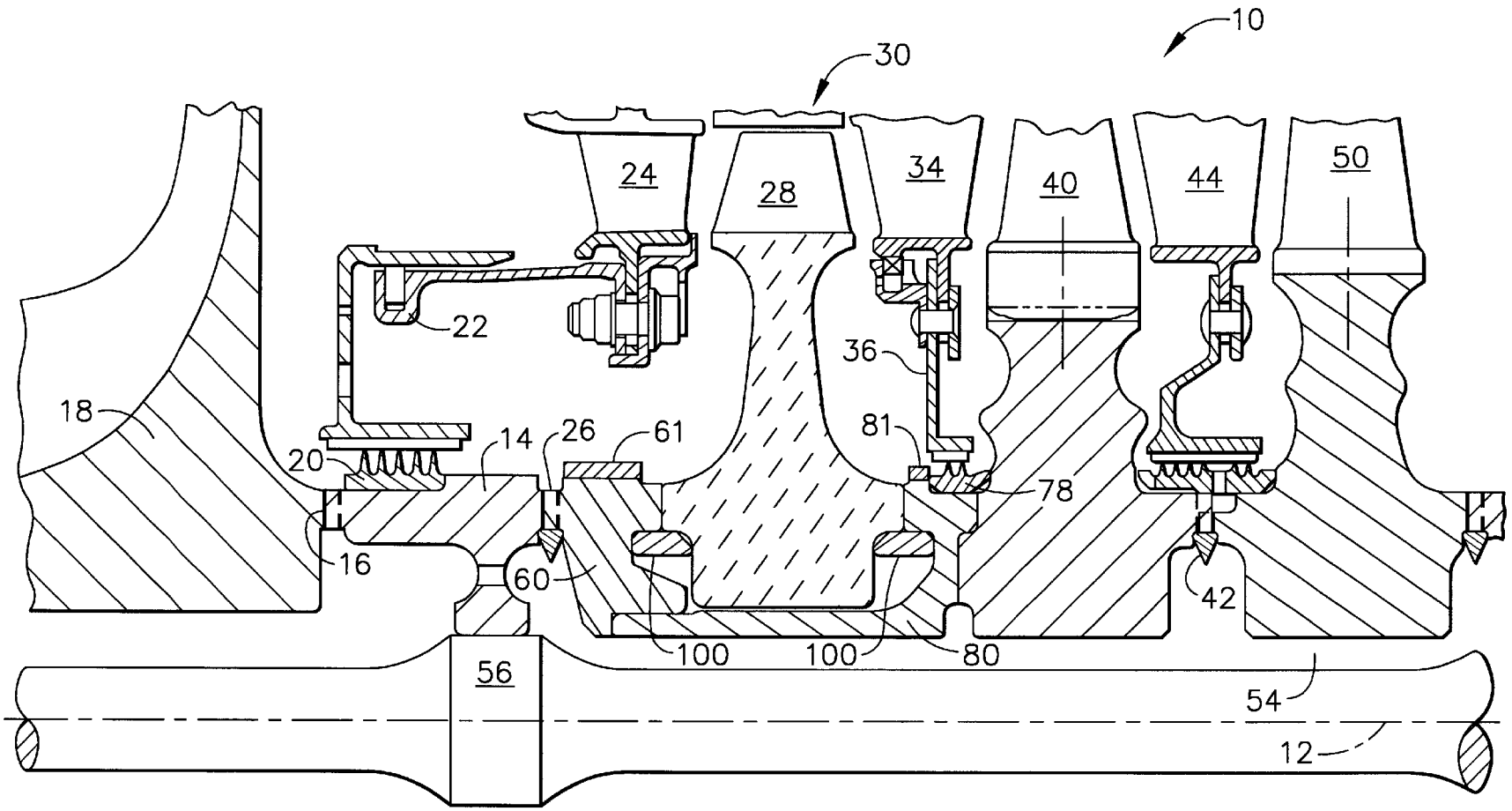
FIG. 1 is a cross-section of a gas turbine engine turbine section having the ceramic blisk assembly contemplated by the present invention.

Referring to the drawings, FIG. 1 shows a portion of a turbine section of a gas turbine engine generally denoted by reference numeral 10 which is symmetric about an axial centerline 12. Going from left to right in the axial direction, the turbine section is comprised of the following components. A curvic coupling shaft portion 14 coupled by a curvic 16 at one axial end to a compressor wheel 18. A seal 20 is mounted to the shaft portion 14 for sealing engaging a housing portion 22. A first stage stator 24, having an array of vanes, is coupled on its inner diameter to the housing 22 and on its outer diameter to a turbine shroud, not shown. Moving downstream, (i.e. left to right), from the shaft portion 14 and the first stage stator 24 is the first stage rotor 30, which will described in greater detail later in the specification. The first stage rotor 30 has forward attachment ring or sleeve 60 which is coupled to the shaft portion 14 by a curvic 26 and an aft attachment ring or sleeve 80 which abuts a second stage rotor 40. Disposed between the first stage rotor 30 and the second stage rotor 40 is a second stage stator 34. Mounted to the aft attachment ring 80 is a seal 78 that seals against a housing portion 36 of the second stage stator 34. A curvic 42 couples the second stage rotor 40 to a third stage rotor 50. Disposed between the second and third rotor stages is a third stage stator 44. Rotating components 14, 60, 80, 40, and 50 are annular and their inner surfaces define a bore 54 that extends axially through the center of the turbine section 10. A tie shaft 56 is disposed within the bore 54 and used to provide an axial force that holds these rotating components together. This axial force is on the order of 30,000 lbf, but will vary with application. These rotating components are made from conventional gas turbine engine materials such as nickel based superalloys.

Figure 2:
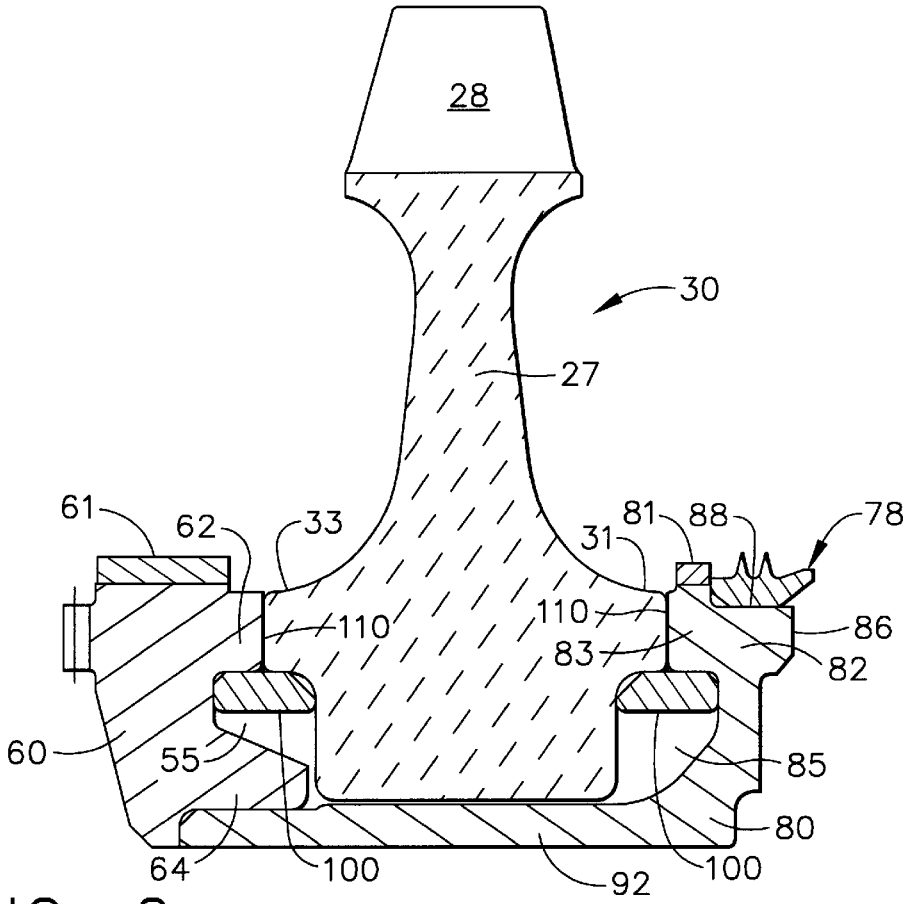
FIG. 2 is a cross-section of a ceramic blisk assembly as contemplated by the present invention.
Figure 3:
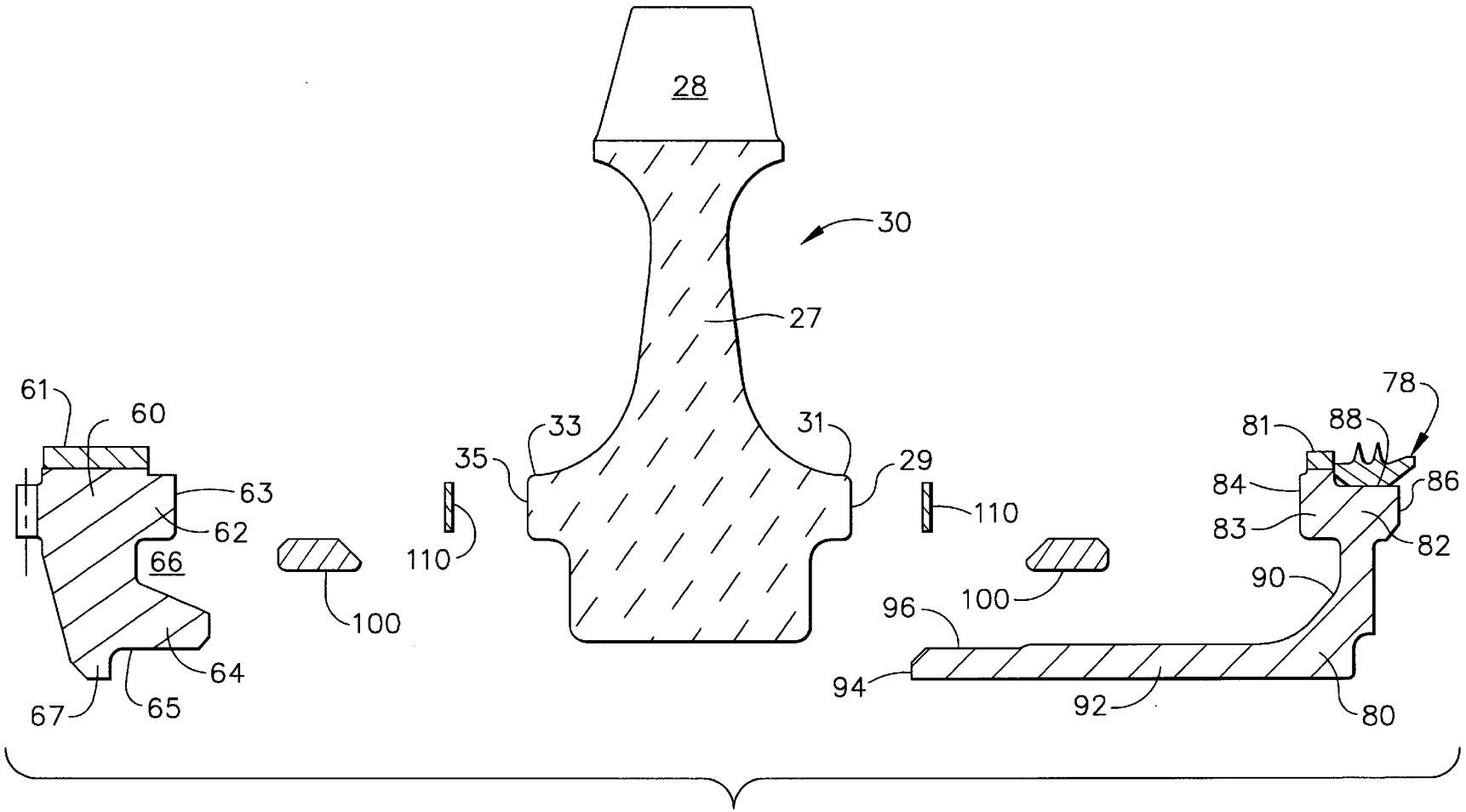
FIG. 3 is an exploded, cross-section of the ceramic blisk assembly of FIG. 2.

Referring to FIGS. 2 and 3, the first stage rotor 30 is a bladed disk 32 which is referred to by those skilled in the art as a blisk, bl(aded) (d)isk. The disk 27 is a one piece structure comprising a wheel or disk 27 integral with an array of blades 28 extending radially therefrom. The disk 27 is made of a ceramic such as silicon nitride ($Si_3N_4$) or silicon carbide (SiC). The disk 27 has axially extending annular lips 31 and 33 having axial facing surfaces 29 and 35 respectively. The first stage rotor 30 further includes the forward attachment ring 60. On its side adjacent the blisk 32, ring 60 has axially extending lips 62 and 64. In the preferred embodiment, the two lips 62 and 64 are of unequal lengths. Together, however, they define an annular groove 66. The lip 62 has an axial facing surface 63 and the lip 64 has a radially inward facing surface 65 that ends in one axial direction at a radially inward extending stop 67. On its opposite side, the ring 60 is configured to be coupled to the shaft portion 14 by curvic 26. The cross-sectional shape of the ring 60 is, to a large degree, dictated by the space available and can be expected to vary from application to application. In an alternative embodiment, the ring 60 can be integral with the shaft portion 14.

The aft attachment ring 80 has a rim portion 82 with an axial facing surfaces 84 and 86, and a radial outward facing surface 88 upon which is mounted the seal 78. A neck portion 90, which is thinner in the axial direction than the rim portion 82, extends radially inward from the rim portion 82 to a base portion 92. The base portion 92 extends axially in one direction and has an axial facing surface 94 opposing the stop 67 and a radially outward facing surface 96 for opposing surface 65 of lip 64. The base portion 92 is of sufficient length to extend under the disk 27 and to the forward attachment ring 60. The cross-sectional shape of the ring 80 is, to a large degree, dictated by the space available and can be expected to vary from application to application. Alternatively, the base portion 92 can be a separate piece that is attached to some other rotating component in the engine. For example, it could extend from the turbine wheel in the second stage rotor. Both attachment rings 60 and 80 have balance material portions 61, 81 for dynamic balancing of the ceramic blisk assembly.

Figure 4:
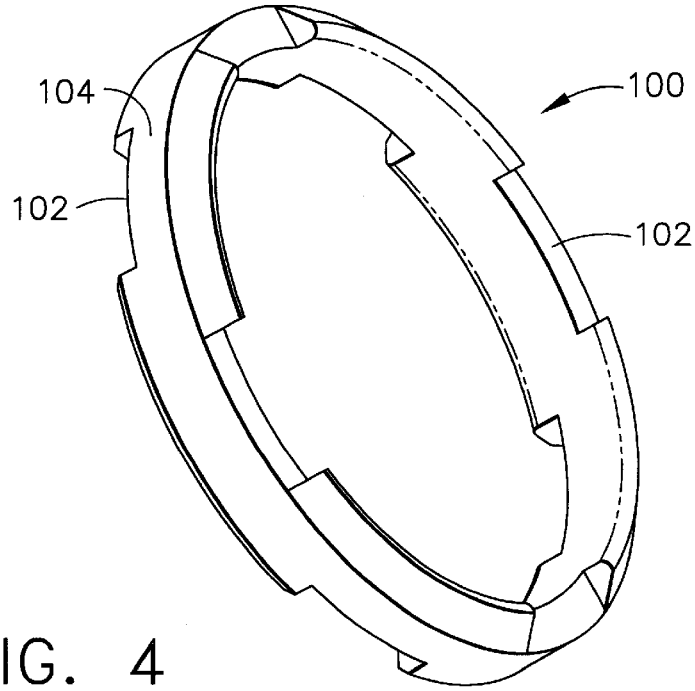
FIG. 4 a perspective view of a pilot ring which is a component of the assembly of FIG. 2
Figure 6:
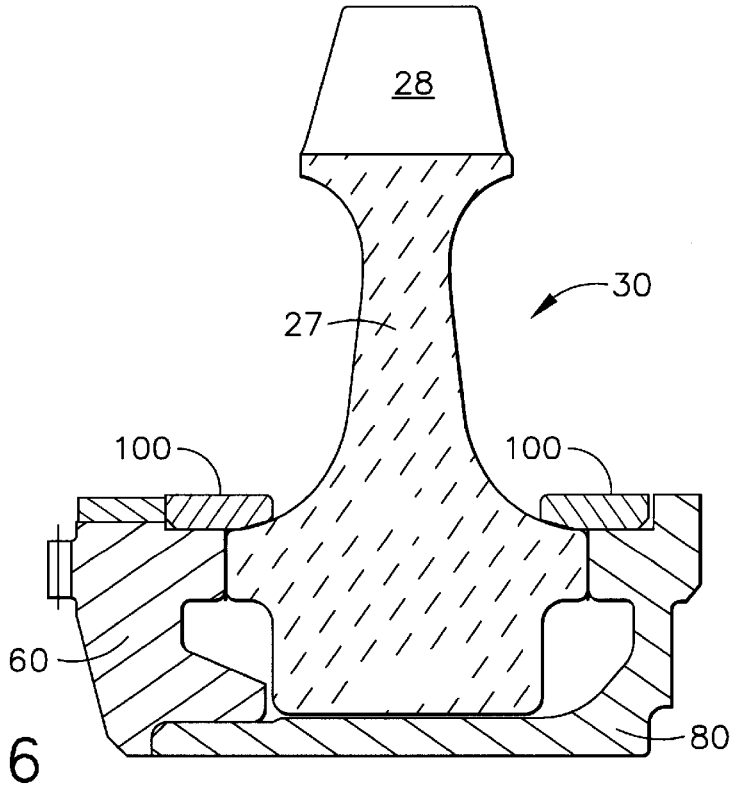
FIG. 6 is a cross-section of an alternative embodiment of the ceramic blisk assembly of FIG. 2.

Still referring to FIGS. 2 and 3, when assembled surface 63 contacts surface 35 and surface 84 contacts surface 29. Additionally, between surface 94 and stop 67 and between surface 96 and surface 65 there is a gap of about one to five thousandth of an inch during operation. Due to the shape of the components, when assembled an annular space 55 below contacting lips 62 and 33 is formed. Likewise, an annular space 85 is formed beneath lips 31 and a lip 83 of rim portion 82. Disposed in each of these annular spaces 55, 85 is a pilot ring 100. Referring to FIG. 4, the pilot rings 100 have a plurality of circumferentially spaced slots 102 on both of their axial edges. On the portion of these edges without a slot the edges are rounded. The slots and rounded edges make the pilot ring more compliant and allow for rolling in the radial direction as the various parts around the ring grow at different thermal rates. This helps to reduce the contact stresses in the blisk 32. The pilot rings 100 have a radially outward facing surface 104, which provide radial positioning or piloting of the disk 27 when the components are assembled. The ring is made from conventional gas turbine engine metal such as nickel based supper alloy or alternatively can be made of ceramic. FIG. 6 shows an alternative embodiment where the pilot rings 100 are dispersed around the contacting lips 62, 33 and 31, 84.

Figure 5:
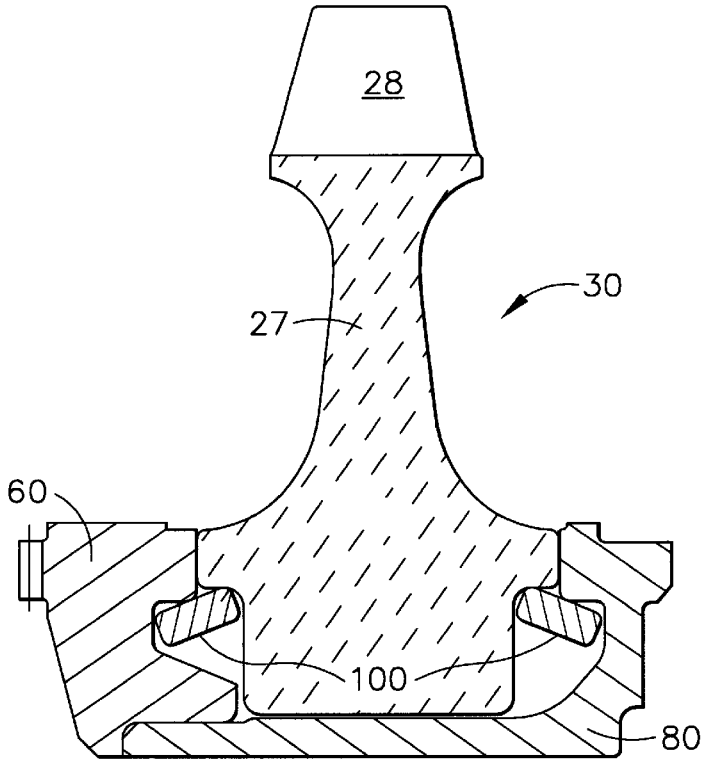
FIG. 5 is a cross-section of the ceramic blisk assembly of FIG. 2 when the engine is shut down.

The arrangement of rings 60 and 80 with respect to disk 27 as shown in FIG. 2, reflects the desired arrangement while the engine is operating. It is important to remember that because the rings are made of metal, they will expand when exposed to high temperatures while the ceramic wheel will not. Thus, in manufacturing the components of the assembly, the rings 60 and 80 at normal ambient temperature should have a diameter less than the diameter of the disk 27. This is illustrated in FIG. 5 where the difference in diameter results in a tilting of the pilot rings 100, which is exaggerated in the drawing. In the preferred embodiment, the rings should have a diameter 1 to 20 thousandths of inch less than the diameter of the disk 27. Of course, the actual difference is a function of the actual operating temperature of the engine and the resultant amount of expansion the rings 60 and 80 will experience.

A compliant shim 110 is disposed between surfaces 63 and 35 and surfaces 84 and 29. The shim 110 is made from a titanium based alloy or iron cobalt based alloy. Alternatively, instead of a shim the surfaces can be coated with a precious metal coating which in the preferred embodiment is either gold or platinum. The shim or coating reduces the contact stresses on the ceramic surfaces during assembly and during thermal differential growth. The shim or coating is optional and is used if the contact stress between surfaces gets too large.

Thus, radial piloting is achieved with a flexible pilot ring 100 that is relatively small in cross-sectional area. This minimizes the contact stresses on the ceramic blisk. The ring 100 rolls and maintains contact between itself and the ceramic blisk and between itself and the attachment rings 60 and 80 respectively. Lubrication can be applied to the ring 100 to further reduce contact stresses.

Torque is transmitted across the axial faces 63,35 and 29,84. If required a shim or coating is interposed between these surfaces to further reduce contact stresses in the blisk. Importantly, by using separate structures for radial piloting and torque transmission the design of each can be independently optimized.

In the event of a failure of the ceramic blisk, the ring 80 will contact the ring 60 at the stop 67 and surface 65. This maintains radial piloting and prevents the other rotating components from moving axially to fill the gap created by the disintegration of the ceramic blisk, thereby avoiding a catastrophic failure of the engine.

Figure 7:
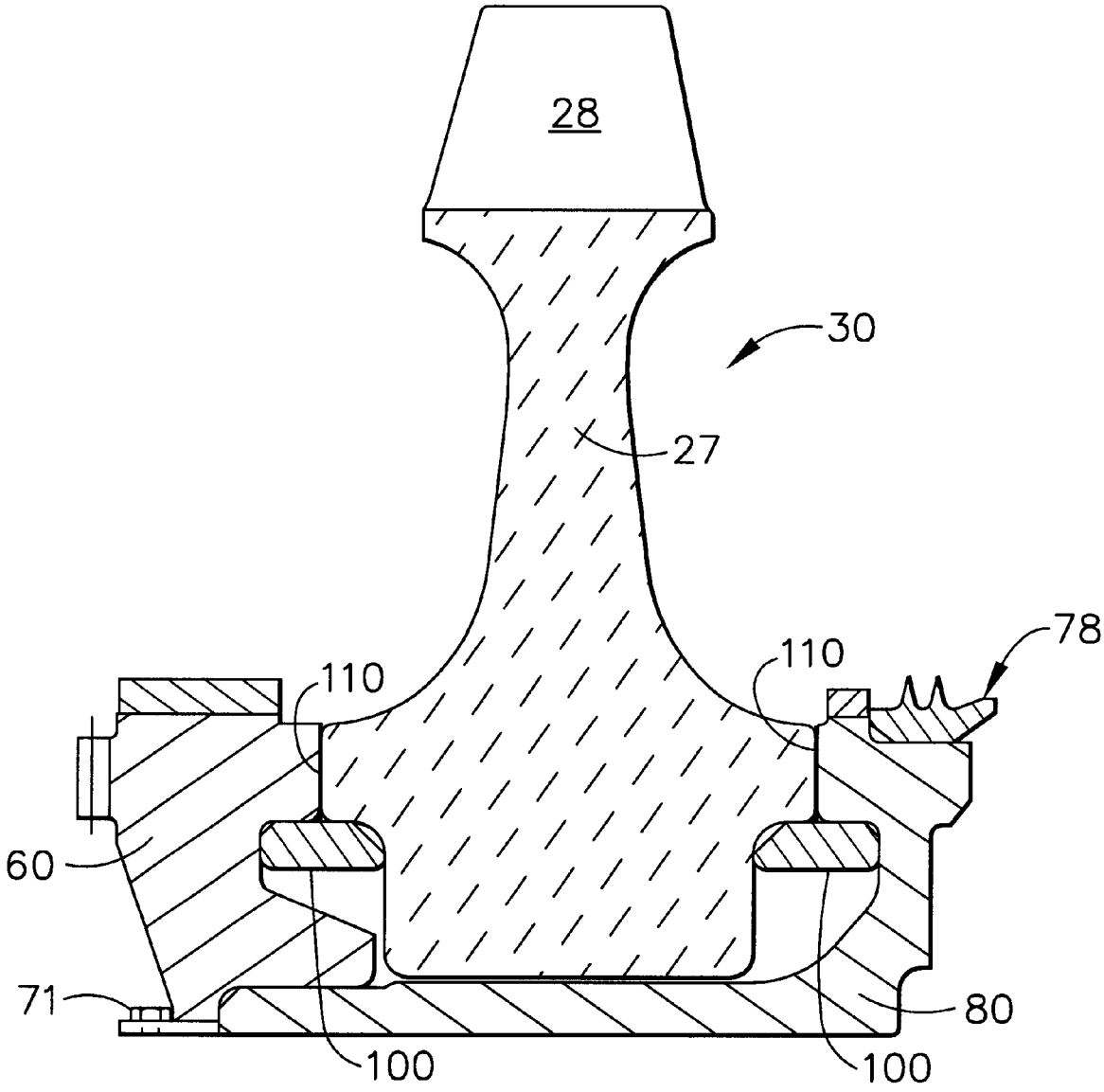
FIG. 7 is a cross-section of another alternative embodiment of the ceramic blisk assembly of FIG. 2.

FIG. 7 shows an alternative embodiment of the present invention where the attachment rings 60 and 80 are coupled together by a nut 71.

Various modifications and alterations to the above-described preferred embodiment will be apparent to those skilled in the art. For example, the subject invention could be used with a ceramic disk having metal inserted blades, a ceramic disk with ceramic inserted blades, any ceramic shaft disposed between two components, and a ceramic journal for a foil or air bearing. Accordingly, these descriptions of the invention should be considered exemplary and not as limiting the scope and spirit of the invention as set forth in the following claims.

What is claimed is:

1. A blisk assembly comprising:

a ceramic blisk having a first and second axial facing surface;

a first metal attachment ring having a third axial facing surface in contact with said first axial facing surface of said blisk, said first attachment ring coupled to a first rotating component in said engine;

a second metal attachment ring having a fourth axial facing surface in contact with said second axial facing surface of said blisk, said second attachment ring coupled to a second rotating component in said engine;

a first pilot ring disposed between said blisk and said first attachment ring; and a second pilot ring disposed between said blisk and said second attachment ring.

2. The blisk assembly of claim 1 further comprising a first precious metal coating disposed between said third axial facing surface and said first axial facing surface and a second precious metal coating disposed between said fourth axial facing surface and said second axial facing surface.

3. The blisk assembly of claim 1 wherein said blisk has a first axially extending annular lip that ends at said first axial facing surface and a second axially extending annular lip that ends at said second axial facing surface.

4. The blisk assembly of claim 3 wherein said first attachment ring has a third axially extending lip that ends at said third axial facing surface.

5. The blisk assembly of claim 1 wherein the diameter of said first and second attachment rings is less than the diameter of said blisk during assembly.

6. The blisk assembly of claim 5 wherein the diameter of said first and second attachment rings is 1 to 20 thousandth of an inch less than the diameter of said blisk.

7. The blisk assembly of claim 1 wherein said ceramic blisk, said first and second attachment rings and said first and second pilot rings are held together by an axial force provided by a tie shaft.

8. The blisk assembly of claim 1 wherein said first pilot ring is located under the point of contact between said first and third axial facing surfaces and said second pilot ring is located about the point of contact between second and fourth axial facing surfaces.

9. The blisk assembly of claim 1 wherein said first pilot ring is located about the point of contact between said first and third axial facing surfaces and said second pilot ring is located about the point of contact between second and fourth axial facing surfaces.

10. A blisk assembly comprising:

a ceramic blisk having a first and second axial facing surface;

a first metal attachment ring having a third axial facing surface in contact with said first axial facing surface of said blisk, said first attachment ring coupled to a first rotating component in said engine;

a second metal attachment ring having a fourth axial facing surface in contact with said second axial facing surface of said blisk, said second attachment ring coupled to a second rotating component in said engine;

a first pilot ring disposed between said blisk and said first attachment ring;

a second pilot ring disposed between said blisk and said second attachment ring; and a first metal shim disposed between said third axial facing surface and said first axial facing surface and a second metal shim disposed between said fourth axial facing and said second axial facing surface.

11. A blisk assembly comprising:

a ceramic blisk having a first and second axial facing surface;

a first metal attachment ring having a third axial facing surface in contact with said first axial facing surface of said blisk, said first attachment ring coupled to a first rotating component in said engine;

a second metal attachment ring having a fourth axial facing surface in contact with said second axial facing surface of said blisk, said second attachment ring coupled to a second rotating component in said engine;

a first pilot ring disposed between said blisk and said first attachment ring;

a second pilot ring disposed between said blisk and said second attachment ring;

said blisk further having a first axially extending annular lip that ends at said first axial facing surface and a second axially extending annular lip that ends at said second axial facing surface;

said first attachment ring further having a third axially extending lip that ends at said third axial facing surface; and a fourth axially extending lip, extending in the same direction as said third axially extending lip to define an annular groove therebetween.

12. The blisk assembly of claim 11 wherein said fourth axially extending lip has a radially inward facing surface that ends at a radially inward extending stop.

13. The blisk assembly of claim 12 wherein said second attachment ring has a rim portion having said fourth axial facing surface, and a neck portion extending radially inward from said rim portion to a base portion.

14. The blisk assembly of claim 13 wherein said base portion extends axially toward said first attachment ring and beneath said blisk.

15. The blisk assembly of claim 14 wherein said base portion has a fifth axially facing surface axially spaced from said stop by a gap.

16. A blisk assembly comprising:

a ceramic blisk having a first and second axial facing surface;

a first metal attachment ring having a third axial facing surface in contact with said first axial facing surface of said blisk, said first attachment ring coupled to a first rotating component in said engine;

a second metal attachment ring having a fourth axial facing surface in contact with said second axial facing surface of said blisk, said second attachment ring coupled to a second rotating component in said engine;

a first pilot ring disposed between said blisk and said first attachment ring;

a second pilot ring disposed between said blisk and said second attachment ring; and said first and second pilot rings have a plurality of circumferentially disposed slots.

17. The blisk assembly of claim 16 wherein said first and second pilot rings have rounded axial edges.

18. A blisk assembly comprising:

a ceramic blisk having a first and second axial facing surface;

a first metal attachment ring having a third axial facing surface in contact with said first axial facing surface of said blisk, said first attachment ring coupled to a first rotating component in said engine;

a second metal attachment ring having a fourth axial facing surface in contact with said second axial facing surface of said blisk, said second attachment ring coupled to a second rotating component in said engine;

a first pilot ring disposed between said blisk and said first attachment ring;

a second pilot ring disposed between said blisk and said second attachment ring; and said first attachment ring is coupled to said second attachment ring.

* * * * *